United States Patent [19]

Talyzin et al.

[11] 4,171,746

[45] Oct. 23, 1979

[54] ARTICLE SORTING APPARATUS

[75] Inventors: Nikolai V. Talyzin; Solomon M. Rozengauz; Vasily F. Tikhonov; Nikolai K. Mosolov, all of Moscow, U.S.S.R.

[73] Assignee: Spetsialnoe, Proektno-konstruktorskoe bjuro Ministerstva svyazi SSSR, U.S.S.R.

[21] Appl. No.: 858,800

[22] Filed: Dec. 8, 1977

[30] Foreign Application Priority Data

Mar. 15, 1977 [SU] U.S.S.R. ..... 2456915[I]

[51] Int. Cl.[2] ..... B07C 9/00

[52] U.S. Cl. ..... 209/657; 209/900; 271/279

[58] Field of Search ..... 209/72, 73, 74 R, 74 M, 209/DIG. 1, 509, 552, 657, 606, 900, 933; 271/64

[56] References Cited

U.S. PATENT DOCUMENTS

| | | | |
|---|---|---|---|
| 3,033,366 | 5/1962 | Atanasoff et al. | 209/74 R X |
| 3,104,006 | 9/1963 | Jones | 209/74 R X |
| 3,674,143 | 7/1972 | Hunter et al. | 209/74 R |

FOREIGN PATENT DOCUMENTS

| | | | |
|---|---|---|---|
| 711840 | 7/1954 | United Kingdom | 209/DIG. 1 |

*Primary Examiner*—Joseph J. Rolla
*Attorney, Agent, or Firm*—Steinberg & Blake

[57] ABSTRACT

The apparatus is intended for automatic sorting of articles, particularly, of postal correspondence. The apparatus comprises a plurality of parallel linear guiding channels with limbs branching off to accumulators of sorted articles, arranged alongside of the guiding channels. At the branching-off points of the guiding channels selectors are provided, arranged successively in the direction of the progress of said articles, the foremost selector in the article-progress direction being the most remote from said accumulators.

2 Claims, 7 Drawing Figures

ARTICLE SORTING APPARATUS

The present invention relates to automatic sorting of articles, and, more particularly, it relates to sorting of file-like articles, e.g. of all kinds of printed forms, checks, bank accounts, office forms, identification cards, printed signatures and various other articles of indefinite shape.

The invention can be used to utmost effectiveness for sorting mailed messages, where automation is introduced at the sorting of letters, small parcels and packages.

Recently, great effort has been dedicated in various countries to develop efficient means of automation of the handling of mail which is to be handled in an even increasing amount, owing to the growing information flow and the expanding demography.

Same as the very thought of telephone exchanges with manual switching over of the communication channels seems nowadays obsolete, in the nearest future manual sorting of mail is going to become definitely impractical, since in both cases the number of operators displays a tendency to become commensurate with the number of subscribers or receivers of information.

Sorting of mail in order to rearrange the messages in a specified sequence in accordance with the groups of the codes of the post offices involves separating letters or like correspondence from a prearranged multitude one by one, guiding them before identification means and making the latter define the respective one of the available accumulators, into which the letter is subsequently delivered.

The mail-sorting process essentially involves one of two alternative states of a letter, viz. a letter is deflected from one transportation channel into another one corresponding to a specified group of accumulators; a letter is either guided from the transporation channel into an accumulator or passes by the latter.

A switchover between the two states, i.e. the deflection of a letter or guiding thereof from the transportation channel is performed by a flap or valve associated with an actuator and control means. In general, this switchover device can be called a selector.

A drive toward increasing the capacity of a sorting arrangement is, first of all, curbed down by the time constant of the actuation of a flap.

Furthermore, the mail-advancing rate cannot be increased indefinitely, since it increases the eventuality of the letters becoming damaged.

The sorting efficiency is also curbed down by the minimum time required to separate a single letter or the like from the prearranged multitude. This time cannot be minimized beyond a certain limit by increasing the suction in suction grippers, when suction-type separators are used, or else by stepping up the letter advance rate when using friction- or adhesion-type separating means, since in either case this, too, leads to an increased amount of damaged mail.

Moreover, the sorting efficiency is curbed down by the time of optoelectronic readout of the digital or other postal code, which time for various reasons, e.g. the time required by a cathode-ray tube to read a postal code, cannot be made indefinitely small.

On the other hand, the operating rate of the electronic part of the control system and readout means, i.e. of the analyzing and decision-taking part, is relatively high, so that this rate is far in advance of the capacity of the mechanical hardware of the system, i.e. of the feeding, transporting and sorting devices.

This inherent discord is, unfortunately, characteristic of the single-flow mail-sorting machines marketed by Telefunken and Standard Elektrik Lorenz in the Federal German Republic, by Toshiba and Nippon Electric Company, Ltd. in Japan, by Masson Scott Thrissel Engineering, Ltd. and GEC-Elliott Precision Controls, Ltd. in Great Britain, by IBM and Burroughs Corporation in the U.S.A.

To step up the sorting efficiency by, among other things, balancing the operation rate of the electronic and mechanical parts of a system, and to provide for operation of the actuators within a cycle time in excess of the overall sorting cycle time, it seems expedient to use not a single-flow sorting pattern employed nowadays by the majority of the available mail-sorting machines, but a multiflow one providing several streams of letters both at the input of the system and within the latter, up to the depositing of the letters in an accumulator, by establishing a multiflow parallel-series feed of the letters and their deposition into the accumulators.

There are already known in the prior art some designs of mail-sorting machines with several letter stream input or feed devices, e.g. the mail-sorting machine disclosed in the FRG Pat. No. 1,172,885, Int. Cl. B 07, dated June 25, 1964.

The machine includes a top accumulator level and a bottom one, arranged alongside of guiding linear channels. The machine further includes several operator stations from each of which a stream of letters is first directed by the conveying mechanism into either the top or bottom level of the accumulators, and then is guided into transverse channels arranged normally to the linear guiding channels of the respective level, with the selectors being operated to define this or that channel along which the letter is to be conveyed into the accumulator.

However, the structure of this machine is not free from disadvantages. With each accumulator having its own guiding transportation channels leading from the stream input area, the transportation/distribution system becomes bulky and difficult to operate. Another disadvantage arises from the fact that at the points of the distribution of the mail by the accumulators streams coming from different inputs meet, which eventually results in overfilling of the linear guiding channels, jamming of the letters, their chaotic advance, etc.

In the structures disclosed in the U.S. Pat. No. 3,837,484, dated Sept. 24, 1974, Class 209-73, and the F.R.G. Pat. No. 2,253,384, dated May 2, 1974, Int. Cl. B 07 c, the last-mentioned disadvantage is partly eliminated. In these patents there is disclosed a mail-sorting system basically similar to the abovediscussed one, with multiple letter stream inputs, wherein the mechanisms for deflecting letters from transverse channels into the linear guiding channels are associated with means for delaying letter distribution, responsive to the overfilling of a channel with letters.

The abovedescribed general principle is inbuilt within all the systems of automatic mail-sorting machines with stations for encoding letters by an operator, wherein the address on a letter is converted into a machine-readable control code marked on the letter.

Among obvious shortcomings of these systems are, firstly, the fact that notwithstanding the presence of several letter stream inputs, the streams unite into a common stream before the common distribution flaps, and, secondly, the incorporation of the letter distribution delay means, which significantly affects the overall throughput of a system.

We have already proposed a multistream system of sorting within an automatic mail-sorting machine of the annular type, disclosed in our applications co-pending in the U.S.A., Great Britain, France, the F.R.G. and Japan.

The numbers of these co-pending Applications are:

U.S. Ser. No. 664,473, now U.S. Pat. No. 4,067,459;
GB No. 9588/76, now U.K. Pat. No. 1,503,102;
FR No. 76 06708, now French Pat. No. 2,303,610;
DT No. 26.10.034, now pending;
Japanese Pat. No. 25975/1976.

The system of sorting letters in this machine includes a plurality of parallel channels, in a number equalling that of the letter input devices. The channels encompass all the accumulators of the system, each level of the accumulators being associated with several distributing channels, also in a number of equalling that of the letter input devices. Said system provides for operation of the mechanisms influencing the direction of the advance of the articles being sorted with a cycle time in excess of the cycle time of the sorting operation.

However, since the system of sorting mail disclosed in our Applications is situated on a cylindrical surface in a two-coordinate space, it likewise has points of intersection of the letter streams, i.e. of the letters or of the rollers of the roller ways conveying the letters.

These points curb down the possibility of stepping up the capacity of the system and, besides, they significantly complicate the construction of the machine, on account of the necessity of providing interlocks governing the distribution of the streams of the articles.

It is an object of the present invention to improve the efficiency of the mail-sorting operation.

It is another object of the present invention to step up the reliability of the operation of the devices distributing letters among the accumulators, including the reliability of the operation of the selectors.

It is still another object of the present invention to enhance the provisions for undamaged state of the articles being sorted.

These and other objects are attained in an apparatus for sorting articles, comprising a plurality of parallel linear guiding channels incorporating selector means, leading to accumulators of sorted articles, arranged alongside of the guiding channels at least at one side thereof, in which apparatus, in accordance with the invention, the guiding channels have limbs branching off to the accumulators, the branching-off points of the adjacent channels not belonging to the same straight line, the said selector means being arranged successively in the direction of the progress of the articles at said branching-off points of the guiding channels, the foremost one of the selectors in the article-progress direction being the one which is the most remote from said accumulators.

Owing to the disclosed structure of the selector means, there are formed several independent streams of the articles, e.g. of letters, both at the input of the letter-sorting apparatus and within the latter, up to the points of depositing the letters into an accumulator, the capacity or throughput of each stream being relatively small, providing for the operation of the flaps, i.e. of the selectors at a sorting cycle time or rate, which is manifold that of the total sorting cycle time or rate, which enhances significantly the reliability of the performance of this essential mechanism of a sorting system, as well as saves the letters from mechanical damage, owing to the reduced speed of their progress in a multistream sorting pattern.

Other objects and advantages of the present invention will become apparent from the following detailed description of an embodiment of the invention, with reference being had to the accompanying drawings, wherein:

FIG. 1 schematically illustrates an apparatus for sorting three streams of letters in orthogonal coordinates;

FIG. 2 schematically illustrates an apparatus for sorting three streams of letters in cylindrical coordinates;

Figure 1:
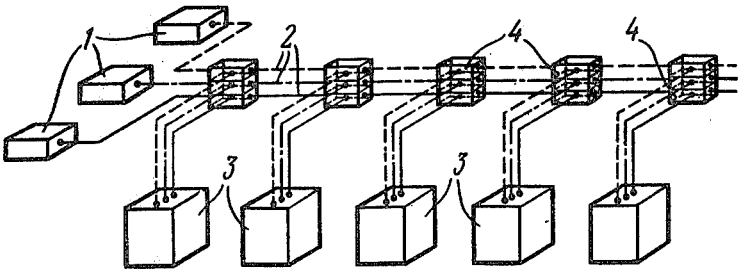
Figure 2:
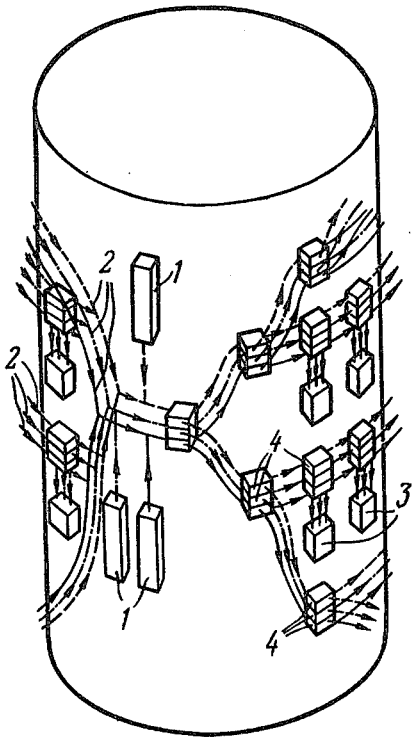

Referring now in particular to the appended drawings, the letter or mail sorting apparatus (FIGS. 1 and 2) comprises letter input or feed means 1 connected via transport means (not indicated in the drawings) with linear guiding channels 2. Accumulators 3 are arranged alongside of the channels 2.

To distribute the letters among the accumulators 3, the transport means with the channels 2 are provided with selectors 4.

Figure 3:
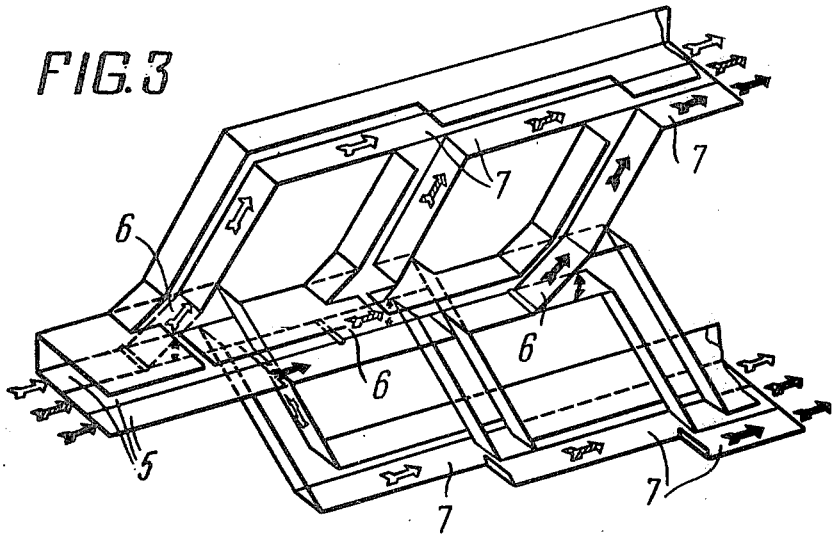
FIG. 3 illustrates a selector unit for varying the direction of the progress of three streams of letters, with linear guiding channels at the input and output of a selector.
Figure 4:
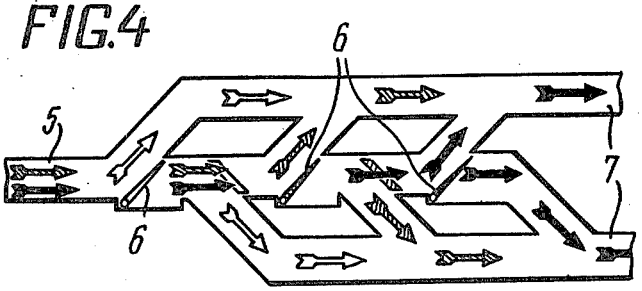
FIG. 4 illustrates the distribution of letters in a selector.

In case of the multistream letter sorting apparatus, the selectors 4 of the guiding transport channels 2 associated with different letter input means 1 are united into a selector unit (FIGS. 3 and 4).

Each selector 4 (FIGS. 3 and 4) includes a transport means with a guiding channel 5 at the input of the selector 4, a flap or valve 6, two transport means with the guiding channels 7 at the output of the selector 4, and a control means (not shown) governing the operation of the flap 6.

The transport means can be in the form of rollers 8 fast with letter-carriers 9 (FIG. 5), e.g. letter holders with their independent drive means, or else they can be in the form of various known per se conveyors running along the guiding linear channels 2.

The respective rollers 8 of the carriers 9 (FIG. 5) of the transport means of different guiding channels 2 are spaced relative to one another in a direction perpendicular to the letter-progress direction, i.e. they are differently offset with respect of the accumulators 3.

The selectors 4 (FIGS. 3, 4, 6 and 7) are successively arranged in the channels 2 of the transport means in the path of the rollers 8, and, same as the rollers 8, are offset relative to one another in the direction perpendicular to the progress of the letters, at different spacing from the accumulators 3; moreover, they are offset relative to one another along the path of the rollers 8, the frontmost one in the letter-progress direction being the selector 4 which is the most remote from the accumulators 3.

The guiding linear channels 2 with the carriers 9 (FIGS. 1, 2 and 5) are offset relative to one another in the three-dimensional space, i.e. in the vertical and horizontal planes, and do not intersect one another.

Each transport means with the guiding channels 2 (FIGS. 1, 2 and 3) has limbs branching off therefrom, e.g. such as the channels 7 at the output of the selector 4, connecting the guiding linear channels 2 with the accumulators 3, the points of the branching off of the adjacent channels 2 not belonging to a single straight line.

It is quite obvious that in case of a multistream letter-sorting apparatus, e.g. having the number of the streams in excess of three, it is sufficient to provide a greater number of relatively offset guiding linear channels 5 and 7, with their carriers 9 and selectors 4, as can be seen in FIG. 3.

The apparatus operates as follows.

Letters to be sorted are fed from the plurality of parallel-installed letter input means 1 (FIGS. 1, 2 and 5) into the carriers 9 received in the corresponding guiding channels 2 successively, one after another.

The cycle time or rate of the input of the articles into the apparatus can be sufficiently small, equalling the minimum time of the handling of the postal code by the electronic part of the system, e.g. by the analyzing and decision-taking circuitry of the readout device and control unit.

While advancing along the channels 2, the letters to be sorted, accommodated in the carriers 9 (FIG. 5), or, to be more precise, in the herein described embodiment the rollers 8 of the carriers 9 of the articles approach along the channel 5 the selectors 4 (FIGS. 1, 2, 3, 4, 6, 7 and 8) to be distributed or sorted into the corresponding one of the channels 7 (FIGS. 3 and 4) at the output of the selector 4 and thus directed into the appropriate accumulator 3 of the apparatus.

Figure 5:
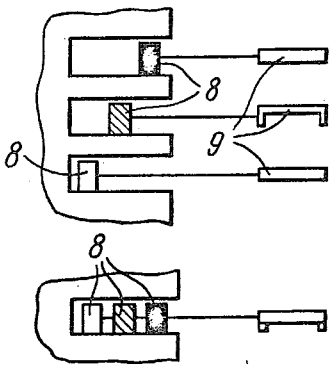
FIG. 5 illustrates a pattern of the arrangement of letter carriers in the guiding linear transport channels.
Figure 6:
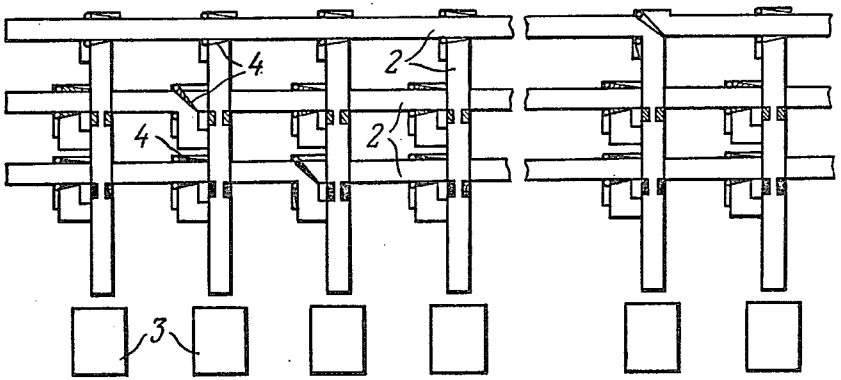
FIG. 6 illustrates the structure of a letter sorting apparatus in rectangular or orthogonal coordinates.
Figure 7:
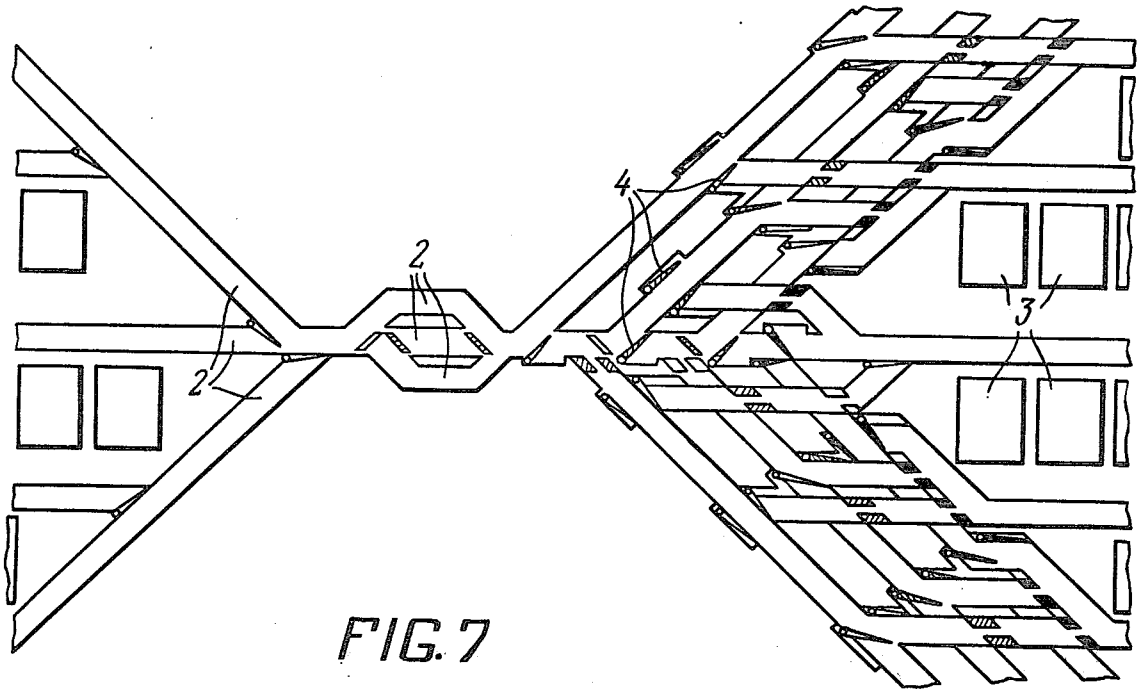
FIG. 7 illustrates the structure of a letter sorting apparatus in cylindrical coordinates, as an involute.

Initially, there takes place the distribution of the carriers 9 of that one of the streams of the letters, of which the rollers 8 are the most remote from the accumulators 3 (in FIGS. 3, 4 and 5 this stream is represented by the unshaded arrow and the unshaded roller). Since the two remaining streams of the rollers 8 are disposed closer to the accumulators 3 (FIG. 5) neither the very letters of these streams, nor the respective rollers 8, nor the brackets of the respective carriers 9 would intersect the unshaded flap 6 (FIGS. 3 and 5), whereby the latter operates at a rate defined by the rate of the distribution of this sole stream, the most remote from the accumulators. Similarly, in the sequential manner there is effected the distribution of the two remaining streams, i.e. of the shaded and darkened ones in the drawings, wherein each respective letter-distributing mechanism, i.e. the flap 6 is thus likewise operated at a rate defined by the rate of the distribution or sorting of the sole respective stream of the letters.

Letters to be sorted in different transport means with their respective guiding channels 2 pertaining to the different input means 1 are equally spaced from the accumulators 3 (FIG. 5) and can be guided into common accumulators 3, i.e. while having the different streams in what concerns the carriers 9, or else the rollers 8 of the carriers of the articles (FIGS. 1, 2, 3 and 5), we have a single overall stream of the letters themselves (FIG. 5), encompassing all the accumulators 3 of the apparatus.

Therefore, we have herein disclosed a multistream system with several streams of letters to be sorted, with parallel input and transportation of the letters and their successive distribution among the accumulators.

What is claimed is:

1. Apparatus for sorting articles comprising: a plurality of linearly extending, spaced, parallel guide channels, each of said channels adapted to guide a flow of articles to be sorted therethrough; a plurality of accumulators for collecting sorted articles arranged at least on one side of said plurality of guide channels substantially in the direction of said guide channels so that said guide channels include guide channels of increasing remoteness from said accumulators; a plurality of selector means for altering the flow direction of the objects to be sorted, each of said selector means being located in a respective one of said guide channels in a manner such that the first one of said selector means in the direction of flow of the articles to be sorted is located in the guide channel most remote from said accumulators and the remaining ones of said selector means being located in staggered succession in the direction of article flow within corresponding guide channels in the order of the degree of remoteness of said channels from said accumulators, said selector means further being spaced from each other in a second direction other than in the direction of article flow; and a second plurality of channels branching from said first plurality of channels, each having one end communicating with respective selector means and a second end communicating with respective accumulators.

2. Apparatus for sorting articles as recited in claim 1 wherein said second direction is a direction substantially normal to the direction of flow of said articles.

* * * * *